US008801537B1

(12) United States Patent
Seluga et al.

(10) Patent No.: US 8,801,537 B1
(45) Date of Patent: Aug. 12, 2014

(54) ADJUSTABLE GOLF CLUB SHAFT AND HOSEL ASSEMBLY

(71) Applicant: Callaway Golf Company, Carlsbad, CA (US)

(72) Inventors: James A. Seluga, Carlsbad, CA (US); Homer E. Aguinaldo, Chula Vista, CA (US)

(73) Assignee: Callaway Golf Company, Carlsbad, CA (US)

( * ) Notice: Subject to any disclaimer, the term of this patent is extended or adjusted under 35 U.S.C. 154(b) by 167 days.

(21) Appl. No.: 13/660,882

(22) Filed: Oct. 25, 2012

Related U.S. Application Data

(63) Continuation-in-part of application No. 13/544,037, filed on Jul. 9, 2012, now Pat. No. 8,727,906, which is a continuation-in-part of application No. 13/408,018, filed on Feb. 29, 2012, now Pat. No. 8,715,103, which is a continuation-in-part of application No. 13/332,846, filed on Dec. 21, 2011, which is a continuation-in-part of application No. 13/326,156, filed on Dec. 14, 2011, now Pat. No. 8,715,102, which is a continuation-in-part of application No. 13/311,319, filed on Dec. 5, 2011, now Pat. No. 8,684,859.

(60) Provisional application No. 61/452,523, filed on Mar. 14, 2011, provisional application No. 61/451,523, filed on Mar. 10, 2011.

(51) Int. Cl.
*A63B 53/02* (2006.01)

(52) U.S. Cl.
USPC ..... 473/307; 473/246; 473/309

(58) Field of Classification Search
USPC ..... 473/307, 309, 246; 235/454, 462.03
See application file for complete search history.

(56) References Cited

U.S. PATENT DOCUMENTS

| | | | | |
|---|---|---|---|---|
| 6,104,845 | A * | 8/2000 | Lipman et al. | 382/313 |
| 7,997,997 | B2 * | 8/2011 | Bennett et al. | 473/288 |
| 8,460,195 | B2 * | 6/2013 | Courtney et al. | 600/463 |
| 8,523,701 | B2 * | 9/2013 | Knutson et al. | 473/307 |
| 2012/0034996 | A1 * | 2/2012 | Murphy et al. | 473/307 |
| 2013/0029790 | A1 | 1/2013 | Clark | |
| 2013/0196784 | A1 * | 8/2013 | Clausen et al. | 473/242 |

FOREIGN PATENT DOCUMENTS

WO WO 2009/035345 * 3/2009

* cited by examiner

*Primary Examiner* — Stephen L. Blau
(74) *Attorney, Agent, or Firm* — Rebecca Hanovice; Michael A. Catania; Sonia Lari

(57) ABSTRACT

An adjustable golf club including a shaft and hosel assembly allows for dependent and independent adjustment of a golf club's face angle, loft angle, and lie angle. The adjustable shaft and hosel assembly comprises a shaft sleeve, a hosel portion, and at least one tubular adjustment piece having non-parallel upper and lower surfaces, wherein the shaft sleeve, hosel, and tubular adjustment piece each include markings that combine to form a code that correlates to a unique angular setting and is readable by an electronic device. The adjustable golf club may also comprise an audible feedback system including an indexing ring that interacts with indexing features in the tubular adjustment piece.

18 Claims, 7 Drawing Sheets

ADJUSTABLE GOLF CLUB SHAFT AND HOSEL ASSEMBLY

CROSS REFERENCES TO RELATED APPLICATIONS

The present application is a continuation-in-part of U.S. patent application Ser. No. 13/544,037, filed on Jul. 9, 2012, which is a continuation-in-part of U.S. patent application Ser. No. 13/408,018, filed on Feb. 29, 2012, which is a continuation-in-part of U.S. patent application Ser. No. 13/332,846, filed on Dec. 21, 2011, which is a continuation-in-part of U.S. patent application Ser. No. 13/326,156, filed on Dec. 14, 2011, which is a continuation-in-part of U.S. patent application Ser. No. 13/311,319, filed on Dec. 5, 2011, which claims priority to U.S. Provisional Application No. 61/451,523, filed on Mar. 10, 2011, and to U.S. Provisional Application No. 61/452,521, filed on Mar. 14, 2011, to each of which the present application also claims priority, and the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head having an adjustable shaft and hosel assembly. More specifically, the present invention relates to a golf club shaft and hosel connection assembly that allows a user to adjust the loft, lie, and face angle of the golf club head, either dependently or independently without requiring the user to remove the shaft from the hosel completely.

2. Description of the Related Art

It is known that changing the angle of a golf club shaft with respect to the golf club head will change certain club specifications, including loft angle, lie angle, and face angle. Several types of adjustable golf clubs are currently available on the market. These models allow the user to adjust loft, lie and face angle by adjusting certain golf club components, which themselves rotate the shaft in a cone-shaped path about a reference axis.

Current adjustable golf club models include rotatable component features that are used for angle indexing and for transmitting torque forces between the club body and shaft, and vice-versa. These component features limit the number of shaft angle adjustments, however. The maximum angular range of these designs has been found to be approximately ±2.0° from the reference axis. None of the currently available adjustable golf clubs permit a 0° angle adjustment with respect to the reference axis.

The adjustable golf club models currently on the market have other drawbacks in addition to limited shaft angle adjustability. Because the shaft is fixed to the standard rotating features of these golf clubs, which operate on a fixed cone range of movement, the shaft graphics and grip reminder rotate out of orientation with the club head body when angles are adjusted. This can frustrate golfers who rely on grip reminders or asymmetric grips while using their clubs.

Furthermore, in many cases a user has to remove certain shaft components to make angle adjustments, thus increasing the difficulty of making adjustments as well as increasing the likelihood that the user will lose important pieces of the adjustable golf club head. For example, with current designs, shaft interchangeability is achieved by removing mechanical fastener(s) that attach the shaft component to the club head body. A different shafted component can then be added and the mechanical fastener(s) can be re-used to attach the shaft component to the club head body. Golfers run the risk of losing the mechanical fastener(s) when they make desired adjustments.

BRIEF SUMMARY OF THE INVENTION

The present invention relates to wood golf club heads that have angular adjustable shaft and hosel assemblies. In particular, the present invention relates to an adjustable hosel system having a feedback mechanism that indicates to a user that an adjustment is occurring without hindering the adjustment itself. The present invention also relates to an adjustable hosel system having machine-readable markings that allow a golfer to use an electronic device to interpret loft and lie settings, thus simplifying the adjustment experience.

One aspect of the present invention is an adjustable golf club comprising a shaft sleeve with a shaft-receiving bore and an external surface having a first reference marking, a first tubular adjustment piece comprising an external surface having a first positional marking extending at least part way around the circumference of the first tubular adjustment piece, and non-parallel upper and lower surfaces, the first tubular adjustment piece encircling at least a portion of the shaft sleeve, a second tubular adjustment piece comprising an external surface having a second positional marking extending at least part way around the circumference of the second tubular adjustment piece, and non-parallel upper and lower surfaces, the second tubular adjustment piece encircling at least a portion of the shaft sleeve, and a golf club head comprising a hosel, the hosel comprising a hosel bore and an external surface having a second reference marking, at least part of the hosel bore having a diameter sized to receive at least a part of the shaft sleeve, wherein when at least part of the shaft sleeve is disposed within the hosel bore, rotating at least one of the first and second tubular adjustment pieces around the shaft sleeve changes an angle of the shaft sleeve with respect to the hosel, creating a plurality of different angular settings, wherein the first reference marking and the second reference marking create a readable reference frame, and wherein each angular setting correlates to a unique readable code formed by the first reference marking, first positional marking, second positional marking, and second reference marking when viewed within the reference frame.

In one embodiment, rotating the first tubular adjustment piece around the shaft sleeve may change a first distance between the first reference marking and the first positional marking within the reference frame and a second distance between the first positional marking and the second positional marking within the reference frame, rotating the second tubular adjustment piece around the shaft sleeve may change the second distance and a third distance between the second positional marking and the second reference marking within the reference frame, and each unique readable code may have a different combination of first, second, and third distances. In some embodiments, the readable code may be readable by an electronic device, such as a scanner or a mobile phone with a scanner application, which may be configured to analyze the readable code, associate the readable code with its correlated angular setting, and display the loft and lie angle of the golf club head. In some embodiments, the first positional marking may be a line that extends around the entire circumference of the first tubular adjustment piece, and the second positional marking may also be a line that extends around the entire circumference of the second tubular adjustment piece. In a further embodiment, the adjustable golf club may comprise a fastener to removably fix the shaft sleeve within the hosel, and tightening the fastener may prevent the first and second tubular adjustment pieces from moving around the shaft sleeve.

Another aspect of the present invention is an adjustable golf club comprising a shaft sleeve with a shaft-receiving bore and an external surface having a first reference marking, a tubular adjustment piece comprising an external surface having a positional marking extending completely around the circumference of the tubular adjustment piece, and non-parallel upper and lower surfaces, the tubular adjustment piece encircling at least a portion of the shaft sleeve, and a golf club head comprising a hosel, the hosel comprising a hosel bore and an external surface having a second reference marking, at least part of the hosel bore having a diameter sized to receive at least a part of the shaft sleeve, wherein when at least part of the shaft sleeve is disposed within the hosel bore, rotating the tubular adjustment piece around the shaft sleeve changes an angle of the shaft sleeve with respect to the hosel, creating a plurality of different angular settings, wherein the first reference marking and the second reference marking create a reference frame readable by an electronic device, wherein each angular setting correlates to a unique readable code formed by the first reference marking, the positional marking, and the second positional marking when viewed within the reference frame, and wherein the electronic device is configured to analyze the readable code, associate the readable code with its correlated angular setting, and display the loft and lie angle of the golf club head.

Yet another aspect of the present invention is an adjustable consumer product comprising a first movable part comprising a first line marking, a second movable part comprising a second line marking, and a third non-movable part comprising a third line marking, wherein the first and second movable parts can be moved to adjust a setting of the consumer product, wherein the consumer product has a plurality of different settings, wherein adjustment of the first and second movable parts changes the configuration of the first, second, and third line markings with respect to one another, wherein each configuration of the first, second, and third line markings forms a readable code, and wherein each of the plurality of different settings has a unique readable code.

Another aspect of the present invention is an adjustable golf club comprising a shaft sleeve comprising a shaft-receiving bore, a first tubular adjustment piece comprising non-parallel upper and lower surfaces, the first tubular adjustment piece encircling at least a portion of the shaft sleeve, a second tubular adjustment piece comprising non-parallel upper and lower surfaces, the second tubular adjustment piece encircling at least a portion of the shaft sleeve, a first indexing ring comprising a ring portion and a tang portion, the ring portion encircling at least a portion of the shaft sleeve and the tang portion extending away from the ring portion, and a golf club head comprising a hosel, the hosel comprising a hosel bore, at least part of the hosel bore having a diameter sized to receive at least a part of the shaft sleeve, wherein at least one of the first and second tubular adjustment pieces comprises an interior surface with an indexing feature extending away from the interior surface, wherein the first indexing ring is disposed proximate the tubular adjustment piece comprising the indexing feature such that the tang portion extends towards the indexing feature, wherein when at least part of the shaft sleeve is disposed within the hosel bore, rotating at least one of the first and second tubular adjustment pieces around the shaft sleeve changes the angle of the shaft sleeve with respect to the golf club head, and wherein rotating the tubular adjustment piece comprising the indexing feature causes the tang portion to make contact with the indexing feature and create a sound audible to the human ear as it moves across the indexing feature.

In some embodiments, the first tubular adjustment piece may comprise the indexing feature, and the first indexing ring may be disposed below the first tubular adjustment piece, while in other embodiments, the second tubular adjustment piece may comprise the indexing feature, and the first indexing ring may be disposed below the first tubular adjustment piece. In some embodiments, the indexing feature may comprise a plurality of ridges and valleys, and friction between the tang portion and the ridges creates the audible sound. In other embodiments, the indexing feature may comprise a plurality of teeth and gaps, and friction between the tang portion and the teeth creates the audible sound. In some embodiments, the first indexing ring may be disposed underneath the tubular adjustment piece comprising the indexing feature such that the tang portion extends underneath the indexing feature and retains the tubular adjustment piece on the shaft sleeve. In some embodiments, the first indexing ring may be permanently and non-rotatably affixed to the shaft sleeve, and may be composed of a lightweight material selected from the group consisting of composite, plastic, and aluminum alloy.

In a further embodiment, the adjustable golf club may comprise a second indexing ring having a ring portion and a tang portion. In this embodiment, each tubular adjustment piece may comprise an indexing feature, the first indexing ring may be disposed proximate the first tubular adjustment piece, the second indexing ring may be disposed proximate the second tubular adjustment piece, and rotating each of the first and second tubular adjustment pieces may create a sound audible to the human ear as the tang portion of each of the indexing rings interacts with the indexing feature of the most proximate tubular adjustment piece. Each of the first and second indexing rings may be permanently and non-rotatably affixed to the shaft sleeve, and may further be composed of a lightweight material selected from the group consisting of composite, plastic, and aluminum alloy.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
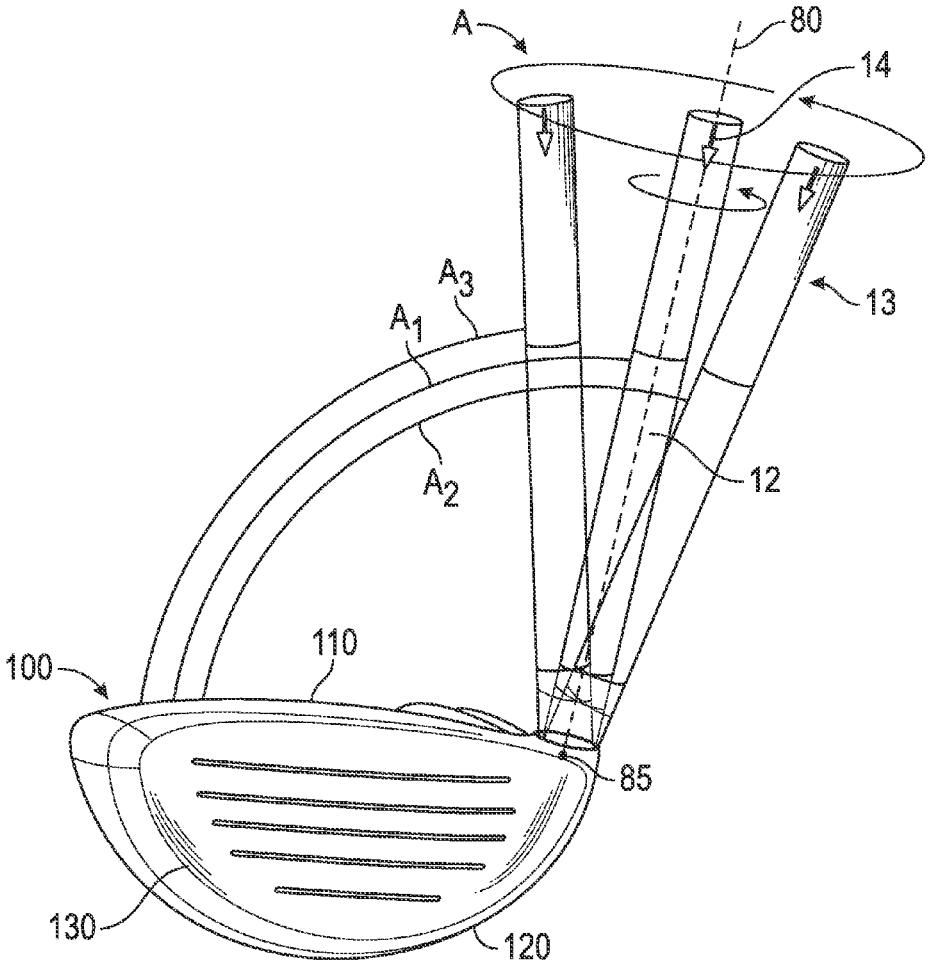
FIG. 1 is a side, perspective view of a golf club head having adjustability features included in the first embodiment of the present invention.
Figure 2:
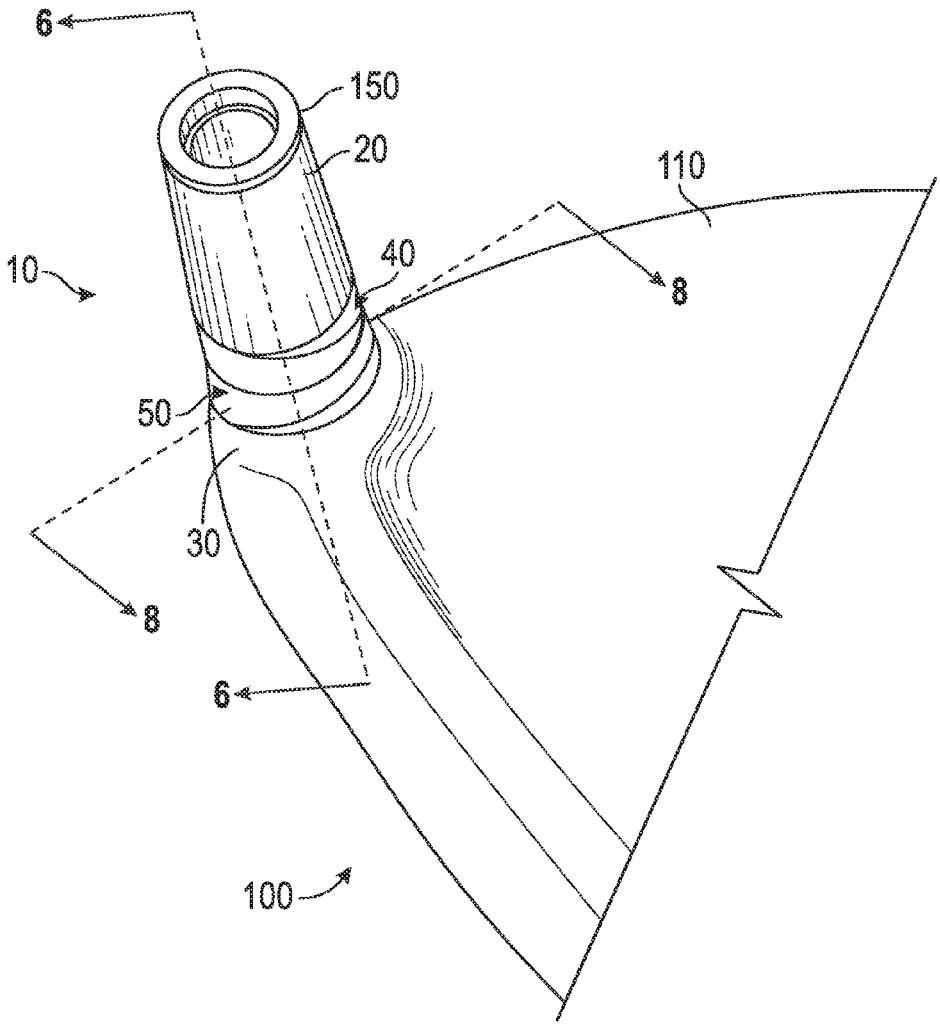
FIG. 2 is top, rear perspective view of a first embodiment of the invention.

Angular adjustability in a golf club head is achieved through universal movement of the golf club shaft with respect to the golf club head, which almost always requires the shaft to rotate around a reference axis. As shown in FIG. 1, unlike other adjustable golf club designs currently available on the market, the present invention allows for universal angular adjustment without requiring the shaft 12, and thus the grip 13, to rotate about a reference axis 80 more than 5 degrees, if at all. As shown, for example, in FIG. 6, the shaft sleeve 20 of the present invention has a bore axis that is coaxial with the overall shaft sleeve 20 axis, such that a shaft 12 disposed within the shaft sleeve 20 will be coaxial with, and not angled with respect to, the shaft sleeve 20. During adjustment of the golf club of the present invention, rotation of the shaft sleeve 20, and thus the shaft 12, around the reference axis 80 is limited or non-existent for the full range of shaft 12 angle adjustability, represented by "A" in FIG. 1, with respect to the golf club head 100 around a rotation point 85. Preferably the full range of adjustability A allows for at least 0.75 degree of hosel axis tilt in any direction. In the present invention, the torque forces between the golf club head 100 and shaft 12 are coupled and, because there is limited or no rotation about the reference axis 80, the shaft graphic and/or the grip reminder 14 remain oriented with the club head body during angular adjustment, as shown in FIG. 1 with respect to shaft-head angles $A_1$, $A_2$, and $A_3$. The full range of shaft 12 angle adjustability A in the present invention includes the 0° angle with respect to the reference axis 80.

In addition to having non-ideal adjustability features, many of the adjustable golf club heads currently available on the market are difficult to use because they require a user to make minute linear movements with respect to a pivot point to achieve the desired angular change. For example, a 1° change that is made using an adjustability feature located 1 inch from the pivot point requires the user to make a precise, 0.0174 inch linear movement. In contrast with the currently available technology, the present invention includes precise methods for setting and fixing the angular adjustments desired.

The present invention provides golfers with a structure that can be used to easily and quickly modify club specifications such as loft, lie and face angle of their golf club. This invention enables golfers to change these specifications at the practice range or golf course. The tools used to alter the club's specifications are few in number and can be carried in a pocket of the user's golf bag. Furthermore, the technical ability required to modify the club specifications with this invention is minimal and its approach is intuitive and easy to understand.

The present invention is also valuable because a golfer's swing often changes over time, which can require alterations to his clubs. A golfer may improve his game through lessons and may gain greater flexibility and strength through practice and exercise. As such, it is reasonable for a golfer to wish to change his club's face, lie, and/or loft angles to help improve his accuracy, distance, and feel as needed or desired. This applies to all types of golf clubs. In fact, though the Figures show the present invention in connection with a driver-type golf club head, the embodiments of the present invention disclosed herein may be used in connection with other wood-type golf club heads as well as with irons and putters.

Figure 5:
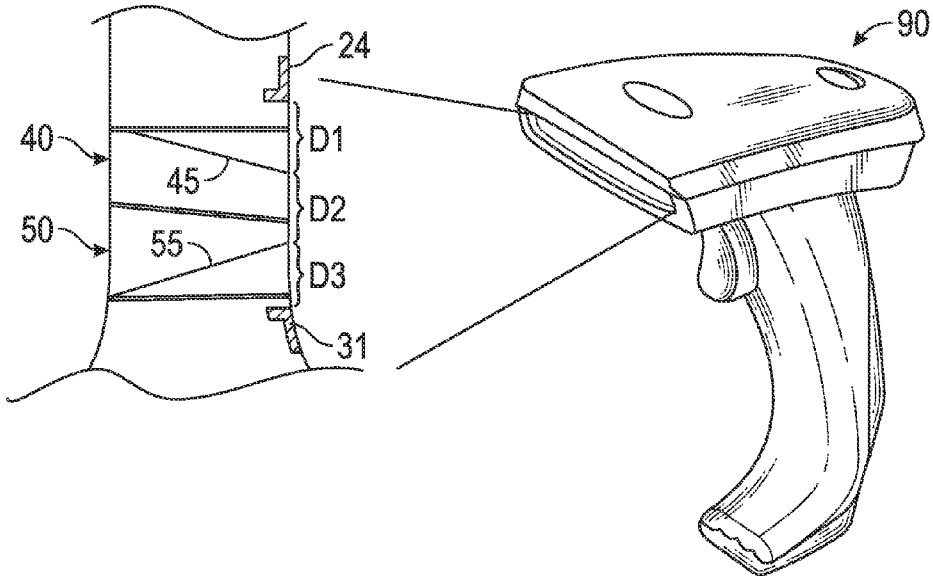
FIG. 5 is an enlarged view of the shims, shaft sleeve, and hosel of the embodiment shown in FIG. 4 being scanned by an electronic reading device.
Figure 6:
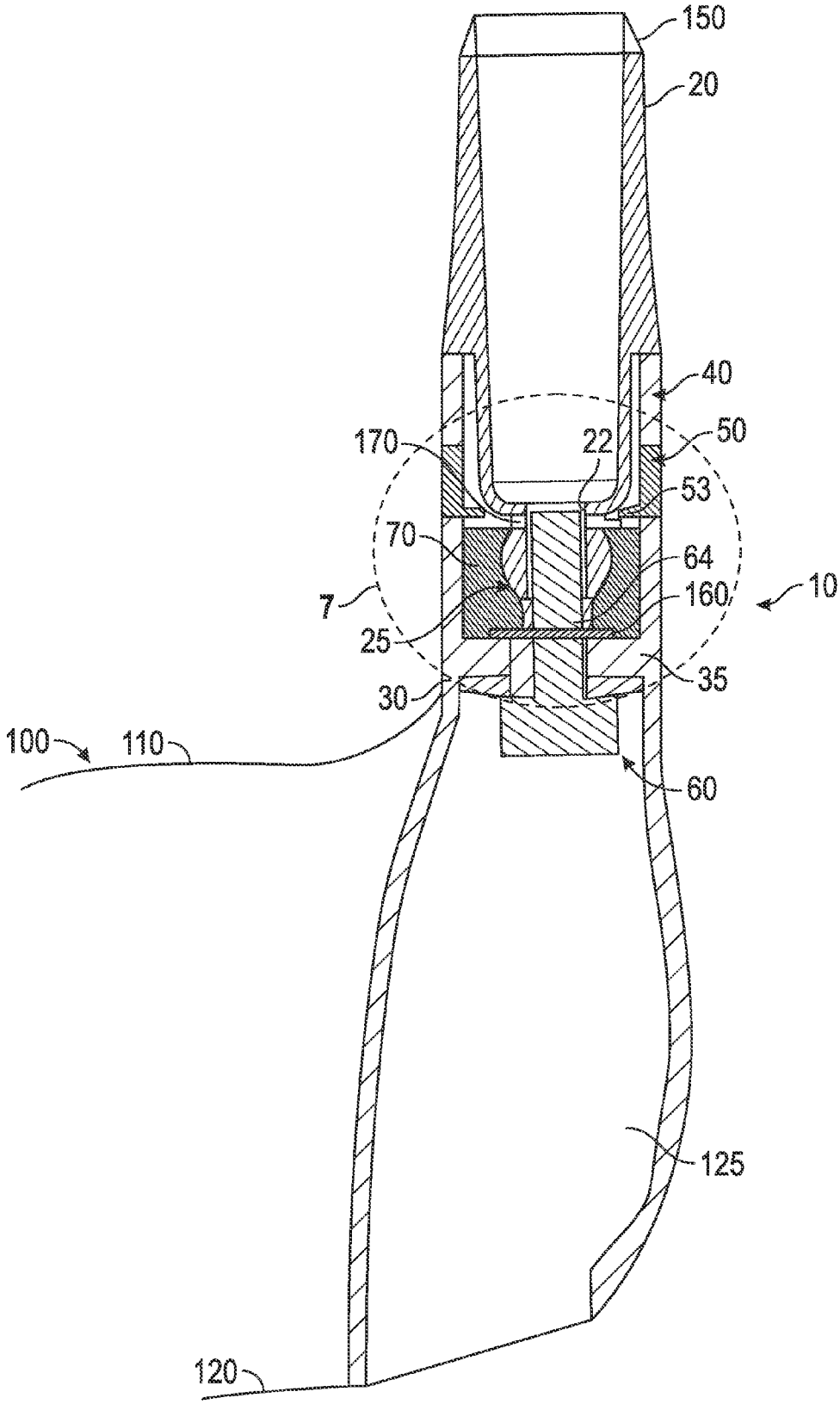
FIG. 6 is a cross-sectional view of the embodiment shown in FIG. 2 along lines 6-6.

A preferred embodiment of the present invention is shown in FIGS. 1-8. This adjustable hosel assembly 10 includes a shaft sleeve 20, a hosel 30, an upper tubular adjustment piece, referred to herein as a shim 40, a lower tubular adjustment piece, also referred to herein as a shim 50, a fastener 60, and a fitting member 70, and is associated with a golf club head 100 having a crown 110, sole 120, and face 130. The assembly 10 may also include a ferrule 150, which can envelope or lie against the shaft (not shown) or the shaft sleeve 20. As shown in FIG. 6, the shaft sleeve 20 includes a universal joint connection 25, which preferably is a protrusion that is flat on two opposing sides and curved or spherical on the other two opposing sides, as shown and described in U.S. patent application Ser. No. 13/544,037, the disclosure of which is hereby incorporated by reference in its entirety herein. The shims 40, 50 encircle the shaft sleeve as shown in FIG. 6, and may be retained on the shaft sleeve as disclosed in U.S. patent application Ser. No. 13/332,846, the disclosure of which is hereby incorporated by reference in its entirety herein. The fitting member 70 fits within the hosel 30 of the adjustable hosel assembly 10 as disclosed in U.S. patent application Ser. No. 13/544,037.

Figure 3A:
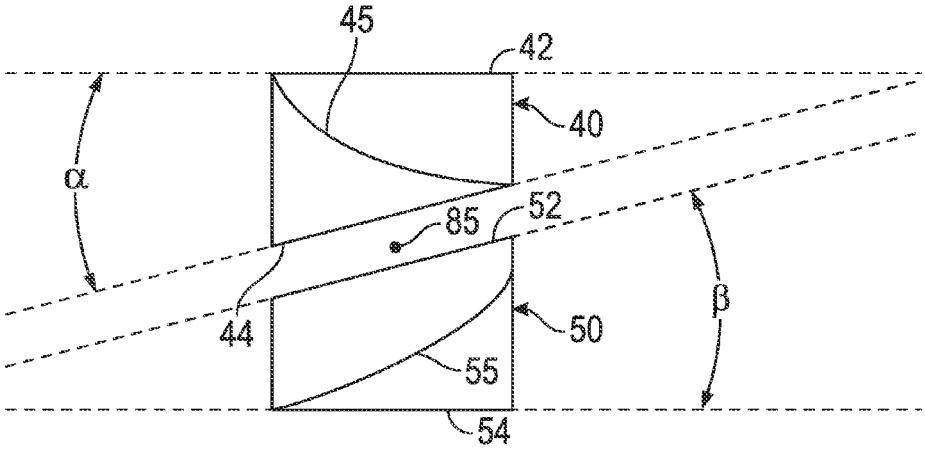
FIG. 3A is a side plan view of the upper and lower shims of the embodiment shown in FIG. 2.
Figure 3B:
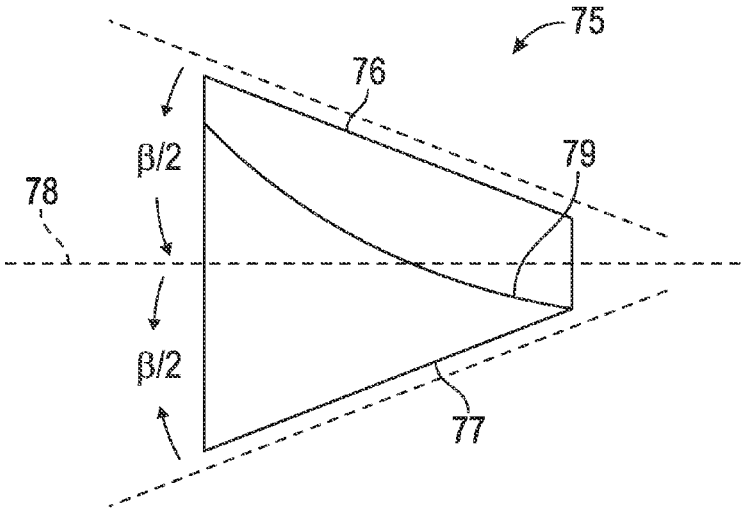
FIG. 3B is a side plan view of a single shim that can be used in an alternative embodiment.
Figure 4:
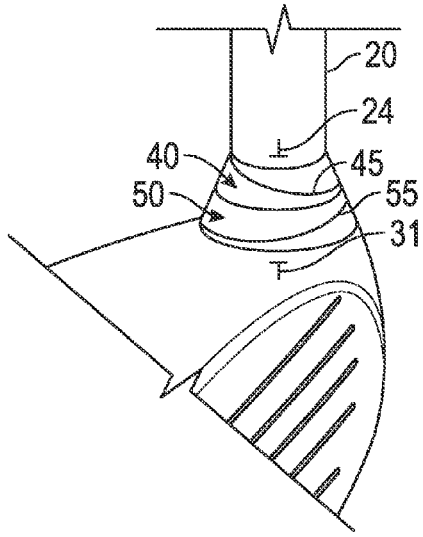
FIG. 4 is a side perspective view of the embodiment shown in FIG. 2.

As shown in FIG. 3A, the shims 40, 50 each have non-parallel (tapered), mating upper surfaces 42, 52 and lower surfaces 44, 54 and work together by moving the shaft sleeve 20, and thus an installed shaft (not shown), so that it has a desired angle with respect to the hosel 30 and thus the golf club head 100. The shims 40, 50 allow a user to rotate the shaft sleeve 20, and thus the shaft, from 0° to a desired maximum degree angle with respect to the reference axis 80. The angle $\alpha$ between the upper and lower surfaces 42, 44 of the upper shim 40 may be equivalent to the angle $\beta$ between the upper and lower surfaces 52, 54 of the lower shim 50, or they may differ. The upper surface 42 of the upper shim 40 may be parallel with the lower surface 54 of the lower shim 50, or these surfaces 42, 54 may be non-parallel. In an alternative embodiment, the shims 40, 50 may be combined into a single adjustment piece 75 having non-parallel upper and lower sides 76, 77 as shown in FIG. 3B and angles $\beta/2$ between their upper and lower sides 76, 77 and a midline 78.

In the preferred embodiment, the shims 40, 50, the hosel 30, and the shaft sleeve 20 (or ferrule 150) each have positional markings 45, 55, 31, 24 as shown in FIGS. 3A, 3B, 4, and 5, that can be scanned and read by a mobile device. The positional markings 45, 55 on the shims are preferably diagonal lines that extend completely around the circumference of the shims 40, 50 and which may also include dots or exes, while the positional markings 31, 24 on the hosel 30 and shaft sleeve 20 preferably are reference markings that allow a digital reader to determine the boundaries of the image that needs to be analyzed.

As shown in FIG. 5, after a golfer adjusts the shims 40, 50, he or she can then take a photograph of the configuration at a reference point defined by the hosel 30 and shaft sleeve 20 markings 31, 24 using a digital camera or mobile phone or scan it into an electronic reader 90, which may be a mobile phone having a scanner application, which then analyzes the distances D1, D2, D3 between the markings 45, 55, 31, 24, which, if they are lines, form a single bar code that is unique to the particular hosel setting, and which correlates to the position of the shaft 12 with respect to the head 100, and thus the loft and/or lie of the club head 100. The markings 45, 55 on the shims 40, 50 are arranged on the shims 40, 50 so that each available adjustment position forms a unique bar code when scanned by the reader 90. In an alternative embodiment which utilizes the single adjustment piece 75 shown in FIG. 3B, the distance between positional markings 79 on the single adjustment piece 75 and the positional markings 31, 24 on the hosel 30 and shaft sleeve 20 can also be electronically analyzed to determine loft and/or lie angle of the golf club head 100.

This inventive feature simplifies the adjustment experience for the golfer and saves the golfer the difficulty of interpreting complex loft/lie adjustment charts or manually entering the current club setting information into an electronic device to understand the setting of his or her adjustable golf club. This feature can be applied to any of the embodiments disclosed or incorporated by reference herein, as well as other consumer adjustable products such as binder settings on skis and snowboards, and other adjustable sporting goods.

The positional markings 45, 55, 31, 24 may, in alternative embodiments, be QR codes or other types of electronically readable markings. In some further embodiments, electronically readable markings, particularly QR codes, can correlate to other features of the club head and its parts, such as the materials used in the shims 40, 50 or weight inserts (not shown), so the user can quickly determine weighting and other mass property features of the golf club head 100.

Figure 7:
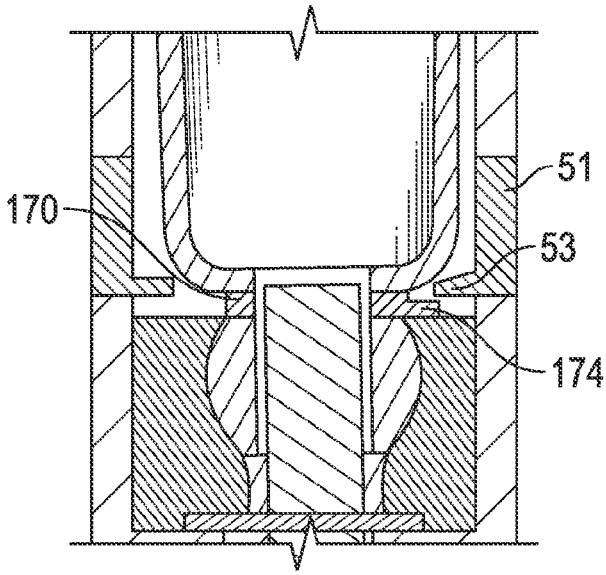
FIG. 7 is an enlarged view of the circled portion of the embodiment shown in FIG. 6.
Figure 8:
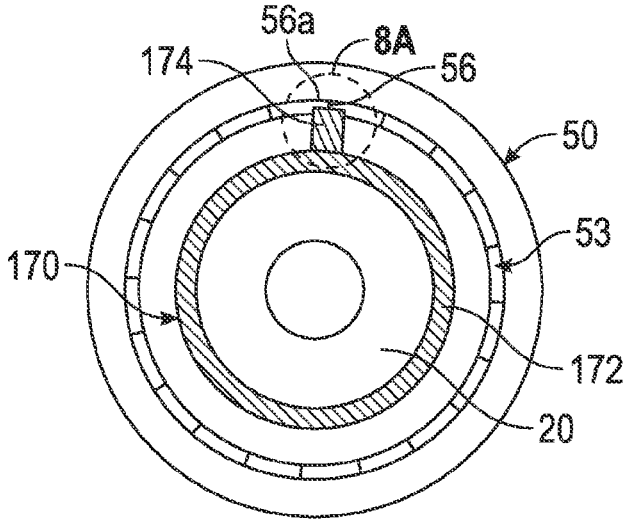
FIG. 8 is a bottom, cross-sectional view of the embodiment shown in FIG. 2 along lines 8-8.
Figure 8A:
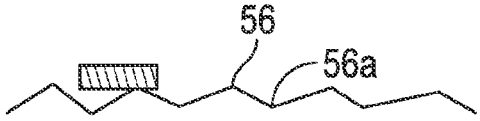
FIG. 8A is a side view of the circled portion of the embodiment shown in FIG. 8.

The shims 40, 50 of the preferred embodiment of the present invention also include feedback features that audibly indicate to a user that the club head loft and/or lie is being adjusted without interfering with the adjustment. As shown in FIGS. 6-8, an indexing ring 170 comprising a ring portion 172 and a tang portion 174 is non-rotatably affixed to the shaft sleeve 20 above the universal joint connection 25. The ring portion 172 encircles the shaft sleeve 20, while the tang portion 174 extends away from the ring portion towards the adjacent shim 50, which in the preferred embodiment is the lower shim 50 but may, in an alternative embodiment, be the upper shim 40. The shim 50 adjacent the indexing ring 170 comprises an indexing feature 53 that extends from an internal surface 51 toward the shaft sleeve 20 and makes contact with the tang portion 174 of the indexing ring 170 as the shim 50 is rotated around the shaft sleeve 20. In the embodiment shown in FIG. 8, the indexing feature 53 includes indexing edges 56 and valleys 56*a*. The friction between the tang portion 174 and indexing edges 56 on the indexing feature 53 creates an audible click during adjustment of the shim 50 and as the tang portion 174 moves across the indexing feature, and allows the user to fine tune the continually adjustable hosel assembly 10. As shown in FIG. 7, the location of the tang portion 174 below the indexing feature 53 of the shim 50 also causes the indexing ring 170 to act as a retainer and prevent the shim 50 from detaching from the shaft sleeve during adjustment. In an alternative embodiment, the tang portion 174 may be located above the indexing feature 53 of the shim 50.

Figure 9:
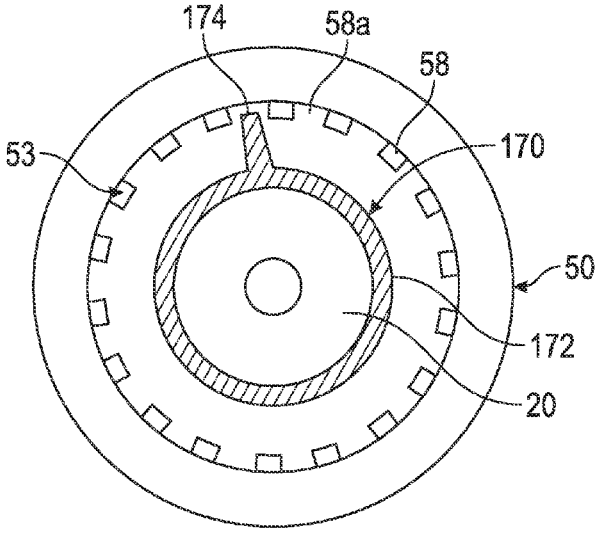
FIG. 9 is an alternative version of the embodiment shown in FIG. 8.

In yet another embodiment, shown in FIG. 9, one or more of the shims 40, 50 may have an indexing feature 53 including teeth 58 extending from an interior surface 41, 51 and the tang portion 174 causes a clicking noise as it slides past the teeth 58 and into gaps 58*a* between the indexing teeth 58 during adjustment. The indexing ring 170 and the indexing features 53 disclosed herein do not bear any of the torque of the assembly 10, and thus can be made of lightweight materials such as plastic or composite.

Figure 10:
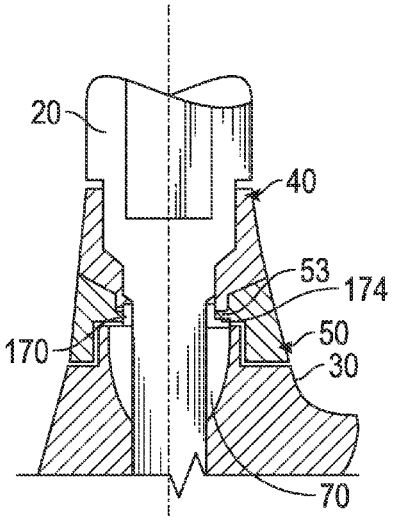
FIG. 10 is a cross-sectional view of a second embodiment of the present invention.
Figure 11:
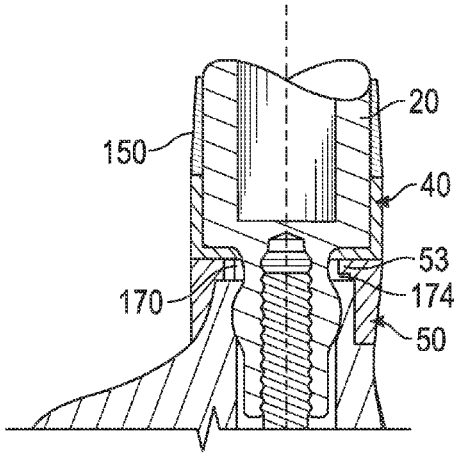
FIG. 11 is a cross-sectional view of a third embodiment of the present invention.

The indexing ring 170 and indexing features 53 of the present invention may be applied to any of the shim embodiments 40, 50 disclosed or incorporated by reference herein. For example, the indexing ring 170 may be included with a shaft sleeve 20 used in connection with convex and concave shims 40, 50, which are described in U.S. patent application Ser. No. 13/544,037, that also have indexing features 53 as shown in FIG. 10, or with a shaft sleeve having a ball joint, also described in U.S. patent application Ser. No. 13/544,037, and two standard shims 40, 50, as shown in FIG. 11. In further embodiments, the shims 40, 50 may also include grooves and ribs, as disclosed in U.S. patent application Ser. No. 13/436,512, the disclosure of which is hereby incorporated by reference herein, or locating pins and sockets to receive said pins to permit a user to more easily select the desired shaft sleeve angles, as shown in U.S. Pat. No. 2,027,452 to Rusing, the relevant disclosure of which is incorporated by reference in its entirety herein.

When the universal joint connection 25, fitting member 70, and hosel 30 are fully assembled with upper and lower shims 40, 50 described herein and shown in FIG. 6, the universal joint connection 25, and hence the shaft sleeve 20, is capable of moving 360° around a rotation point 85 located on the shaft reference axis 80. The greatest force in this assembly is applied within the hosel 30 with respect to the fitting member 70 and universal joint connection 25. In contrast with other adjustable hosel designs currently available on the market, the shims 40, 50, which are located proximate to or around the rotation point 85 to control angular adjustment, as shown in FIGS. 6, 7, 10 and 11, do not bear the brunt of the force between the shaft sleeve 20 and the golf club head 100.

Once the pieces of this embodiment are assembled, the shims 40, 50, shaft sleeve 20, fitting member 70, and hosel 30 of the golf club head 100 are held together by the fastener 60. The fastener 60, which in the preferred embodiment is a bolt or screw, is inserted through an opening 125 in the sole 120 of the golf club head 100 and engages the universal joint connection 25 of the shaft sleeve 20, which includes a hollow, threaded bore 22 sized to receive the fastener 60. In an alternative embodiment, the fastener 60 comprises one or more snap rings, which may or may not be permanently attached to the hosel assembly 10. In the preferred embodiment, the fastener 60 provides the preload force necessary to hold the other components of the embodiment together during use. The component sizes of these connections, and others described herein, are what limit the maximum angular adjustment. Removal of the shaft is not necessary for angular adjustment in this or in other embodiments described herein—instead, the fastener 60 needs only to be loosened from the shaft sleeve 20 so that the component parts can be rotated with respect to each other. As shown in FIG. 6, the fastener 60 pulls the shaft sleeve 20 towards the hosel 30, trapping the shims 40, 50 between the ledge provided by the shaft sleeve 20 (or a ferrule 150, as shown in FIG. 11) and the hosel 30, and pressing the upper shim 40 (or, in an alternative embodiment, the single shim 75) against the ledge provided by the shaft sleeve 20 (or a ferrule 150, as shown in FIG. 11), thus causing the shaft sleeve 20 to tilt with respect to the head 100. In this way, an angle between the shaft sleeve 20 and the head 100 that is selected by a user by rotating the shims 40, 50 around the shaft sleeve 20 can be semi-permanently fixed for use during a round of golf.

As shown in FIGS. 3 and 8, the fastener 60 preferably includes a head 62 and a threaded body 64. In the preferred embodiment, the head 62 of the fastener 60 abuts a flange 35 located within the hosel 30, against which the fitting member 70 can also rest. The flange 35 provides a brace towards which the fastener 60 pulls the other components of the adjustable hosel assembly 10 when fully assembled. The flange 35 is preferably formed integrally with the hosel 30, but may, in an alternative embodiment, be formed as a separate piece and bonded to the hosel 30. In order to prevent loss of the fastener 60 after it is loosened to adjust the angle of the shaft sleeve 20, the fastener 60 may be retained within the hosel 30 of the golf club head 100 by any number of mechanisms or features, including those disclosed in U.S. Pat. No. 8,002,644, the disclosure of which is hereby incorporated in its entirety herein. In the preferred embodiment, the fastener 60 is retained within the hosel 30 by means of an o-ring 160 attached to the threaded body 64 of the fastener 60 after it is inserted into the hosel 30, such that the flange 35 is sandwiched between the head 62 of the fastener 60 or a washer 140 and the o-ring as shown in FIG. 6.

The disclosure of each of U.S. application Ser. Nos. 13/311,319, 13/326,156, 13/332,846, 13/367,045, 13/368,569, 13/408,018, 13/436,412, 13/439,664, and 13/544,037 is hereby incorporated by reference in its entirety herein, and the inventions disclosed herein may be applied to any of the embodiments disclosed in those applications. The embodiments disclosed herein may be made of any number of materials, including those material compositions disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein.

Furthermore, the shims 40, 50, the indexing ring 170, and the fitting member 70 may be composed of lightweight materials, such as plastic, composite, aluminum, titanium alloy, and/or other such materials. The shims 40, 50 and indexing ring 170 may each be made of a different material to allow for adjustments to overall club weight and center of gravity, or they may each be made of the same material. For example, the upper shim 40 can be made of a composite material and the lower shim 50 may be made of a titanium alloy. If a golfer wishes to add weight to the golf club, he can replace one of the shims 40, 50 with a shim 40, 50 made of tungsten or a metal having a greater density.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. An adjustable golf club comprising:

a shaft sleeve comprising a shaft-receiving bore and an external surface having a first reference marking;

a first tubular adjustment piece comprising an external surface having a first positional marking extending at least part way around the circumference of the first tubular adjustment piece, and non-parallel upper and lower surfaces, the first tubular adjustment piece encircling at least a portion of the shaft sleeve;

a second tubular adjustment piece comprising an external surface having a second positional marking extending at least part way around the circumference of the second tubular adjustment piece, and non-parallel upper and lower surfaces, the second tubular adjustment piece encircling at least a portion of the shaft sleeve; and a golf club head comprising a hosel, the hosel comprising a hosel bore and an external surface having a second reference marking, at least part of the hosel bore having a diameter sized to receive at least a part of the shaft sleeve, wherein when at least part of the shaft sleeve is disposed within the hosel bore, rotating at least one of the first and second tubular adjustment pieces around the shaft sleeve changes an angle of the shaft sleeve with respect to the hosel, creating a plurality of different angular settings, wherein the first reference marking and the second reference marking create a readable reference frame, and wherein each angular setting correlates to a unique readable code formed by the first reference marking, first positional marking, second positional marking, and second reference marking when viewed within the reference frame.

2. The adjustable golf club of claim 1, wherein rotating the first tubular adjustment piece around the shaft sleeve changes a first distance between the first reference marking and the first positional marking within the reference frame and a second distance between the first positional marking and the second positional marking within the reference frame, wherein rotating the second tubular adjustment piece around the shaft sleeve changes the second distance and a third distance between the second positional marking and the second reference marking within the reference frame, and wherein each unique readable code has a different combination of first, second, and third distances.

3. The adjustable golf club of claim 1, wherein the readable code is readable by an electronic device.

4. The adjustable golf club of claim 3, wherein the electronic device is configured to analyze the readable code, associate the readable code with its correlated angular setting, and display the loft and lie angle of the golf club head.

5. The adjustable golf club of claim 1, wherein the first positional marking is a line that extends around the entire circumference of the first tubular adjustment piece.

6. The adjustable golf club of claim 1, wherein the second positional marking is a line that extends around the entire circumference of the second tubular adjustment piece.

7. The adjustable golf club of claim 1, further comprising a fastener, wherein the fastener removably fixes the shaft sleeve within the hosel, and wherein tightening the fastener prevents the first and second tubular adjustment pieces from moving around the shaft sleeve.

8. An adjustable golf club comprising:

a shaft sleeve comprising a shaft-receiving bore;

a first tubular adjustment piece comprising non-parallel upper and lower surfaces, the first tubular adjustment piece encircling at least a portion of the shaft sleeve;

a second tubular adjustment piece comprising non-parallel upper and lower surfaces, the second tubular adjustment piece encircling at least a portion of the shaft sleeve;

a first indexing ring comprising a ring portion and a tang portion, the ring portion encircling at least a portion of the shaft sleeve and the tang portion extending away from the ring portion; and a golf club head comprising a hosel, the hosel comprising a hosel bore, at least part of the hosel bore having a diameter sized to receive at least a part of the shaft sleeve, wherein at least one of the first and second tubular adjustment pieces comprises an interior surface with an indexing feature extending away from the interior surface, wherein the first indexing ring is disposed proximate the tubular adjustment piece comprising the indexing feature such that the tang portion extends towards the indexing feature, wherein when at least part of the shaft sleeve is disposed within the hosel bore, rotating at least one of the first and second tubular adjustment pieces around the shaft sleeve changes the angle of the shaft sleeve with respect to the golf club head, and wherein rotating the tubular adjustment piece comprising the indexing feature causes the tang portion to make contact with the indexing feature and create a sound audible to the human ear as it moves across the indexing feature.

9. The adjustable golf club of claim 8, wherein the first tubular adjustment piece comprises the indexing feature, and wherein the first indexing ring is disposed below the first tubular adjustment piece.

10. The adjustable golf club of claim 8, wherein the second tubular adjustment piece comprises the indexing feature, and wherein the first indexing ring is disposed below the first tubular adjustment piece.

11. The adjustable golf club of claim 8, wherein the indexing feature comprises a plurality of ridges and valleys, and wherein friction between the tang portion and the ridges creates the audible sound.

12. The adjustable golf club of claim 8, wherein the indexing feature comprises a plurality of teeth and gaps, and wherein the friction between the tang portion and the teeth creates the audible sound.

13. The adjustable golf club of claim 8, wherein the first indexing ring is disposed underneath the tubular adjustment piece comprising the indexing feature such that the tang portion extends underneath the indexing feature and retains the tubular adjustment piece on the shaft sleeve.

14. The adjustable golf club of claim 8, wherein the first indexing ring is permanently and non-rotatably affixed to the shaft sleeve.

15. The adjustable golf club of claim 8, wherein the first indexing ring is composed of a lightweight material selected from the group consisting of composite, plastic, and aluminum alloy.

16. The adjustable golf club of claim 8, further comprising a second indexing ring having a ring portion and a tang portion, wherein each tubular adjustment piece comprises an indexing feature, wherein the first indexing ring is disposed proximate the first tubular adjustment piece, wherein the second indexing ring is disposed proximate the second tubular adjustment piece, and wherein rotating each of the first and second tubular adjustment pieces creates a sound audible to the human ear as the tang portion of each of the indexing rings interacts with the indexing feature of the most proximate tubular adjustment piece.

17. The adjustable golf club of claim 16, wherein each of the first and second indexing rings is permanently and non-rotatably affixed to the shaft sleeve.

18. The adjustable golf club of claim 16, wherein each of the first and second indexing rings is composed of a lightweight material selected from the group consisting of composite, plastic, and aluminum alloy.

* * * * *